US010103451B2

(12) United States Patent
Dorsey

(10) Patent No.: US 10,103,451 B2
(45) Date of Patent: Oct. 16, 2018

(54) FLEXIBLE POLYMER ANTENNA WITH MULTIPLE GROUND RESONATORS

(71) Applicant: Taoglas Group Holdings Limited, Wexford (IE)

(72) Inventor: Jason Philip Dorsey, Oceaniside, CA (US)

(73) Assignee: TAOGLAS GROUP HOLDINGS LIMITED, Enniscorthy (IE)

( * ) Notice: Subject to any disclaimer, the term of this patent is extended or adjusted under 35 U.S.C. 154(b) by 29 days.

(21) Appl. No.: 15/351,263

(22) Filed: Nov. 14, 2016

(65) Prior Publication Data

US 2017/0133767 A1 May 11, 2017

Related U.S. Application Data

(60) Provisional application No. 62/254,140, filed on Nov. 11, 2015.

(51) Int. Cl.

| | |
|---|---|
| ***H01Q 1/48*** | (2006.01) |
| ***H01Q 1/24*** | (2006.01) |
| ***H01Q 21/20*** | (2006.01) |
| ***H01Q 5/30*** | (2015.01) |
| ***H01Q 1/36*** | (2006.01) |
| ***H01Q 1/38*** | (2006.01) |
| ***H01Q 5/371*** | (2015.01) |

(52) U.S. Cl.

CPC ..... *H01Q 21/20* (2013.01); *H01Q 1/241* (2013.01); *H01Q 1/242* (2013.01); *H01Q 1/36* (2013.01); *H01Q 1/38* (2013.01); *H01Q 1/48* (2013.01); *H01Q 5/30* (2015.01); *H01Q 5/371* (2015.01)

(58) Field of Classification Search

CPC ..... H01Q 5/30; H01Q 5/371; H01Q 1/48; H01Q 1/241; H01Q 1/242; H01Q 1/24

See application file for complete search history.

(56) References Cited

U.S. PATENT DOCUMENTS

| | | | | |
|---|---|---|---|---|
| 7,501,991 | B2 * | 3/2009 | Yeap | H01Q 1/38 343/700 MS |
| 9,755,302 | B2 | 9/2017 | Flores-Cuadras et al. | |
| 2005/0237244 | A1 | 10/2005 | Annabi et al. | |
| 2006/0214867 | A1 | 9/2006 | Chen | |
| 2007/0046557 | A1 | 3/2007 | Chen et al. | |
| 2007/0159398 | A1 | 7/2007 | Tsai et al. | |
| 2010/0090913 | A1 | 4/2010 | Liu | |

(Continued)

FOREIGN PATENT DOCUMENTS

| | | |
|---|---|---|
| GB | 2544415 A | 5/2017 |

*Primary Examiner* — Hoang Nguyen

(74) *Attorney, Agent, or Firm* — Shartsis Friese, LLP; Cecily Anne O'Regan; Kevin J. Everett, Jr.

(57) ABSTRACT

The disclosure concerns an antenna assembly having a substrate with an antenna radiating element and a ground conductor disposed on the substrate, the ground conductor further characterized by a plurality of ground resonators, wherein a length associated with each of the ground resonators increases as the ground resonators are distanced from the antenna radiating element. Additionally, a coaxial cable is routed around the antenna assembly for configuring the coaxial cable as an additional ground resonator associated with the antenna assembly. The resulting antenna provides wide band performance between 700 MHz and 2700 MHz with improved efficiency compared with conventional antennas.

22 Claims, 4 Drawing Sheets

(56) References Cited

U.S. PATENT DOCUMENTS

| | | | | |
|---|---|---|---|---|
| 2010/0245183 | A1 | 9/2010 | Hyvönen et al. | |
| 2011/0279341 | A1* | 11/2011 | Chang | H01Q 1/243 343/822 |
| 2012/0001818 | A1 | 1/2012 | Lee et al. | |
| 2012/0127056 | A1 | 5/2012 | Park et al. | |
| 2013/0249765 | A1 | 9/2013 | Su | |
| 2015/0303556 | A1* | 10/2015 | Flores-Cuadras | H01Q 1/085 343/893 |

* cited by examiner

FLEXIBLE POLYMER ANTENNA WITH MULTIPLE GROUND RESONATORS

CROSS-REFERENCE TO RELATED APPLICATIONS

This application claims benefit of priority with U.S. Provisional Ser. No. 62/254,140, filed Nov. 11, 2015; the contents of which are hereby incorporated by reference.

BACKGROUND

Technical Field

This invention relates to antennas for wireless communication; and more particularly, to an antenna fabricated on a flexible polymer substrate, the antenna including: a radiating element and a ground conductor forming a plurality of ground resonators for providing high performance over a wide bandwidth.

Related Art

There is a continued need for improved antennas, especially flexible antennas, having a flexible configuration for placing on curved surfaces of various products, and being capable of tuning to wide bands (for example: 700 MHz-2700 MHz range).

SUMMARY OF THE INVENTION

Technical Problem

A need exists for an antenna capable of multiple resonance frequencies at a wide band, for example between 700 MHz and 2700 MHz, especially such an antenna that is capable of forming about a curved surface of a device.

Solution to Problem

After much testing and experimentation, the antenna architecture as disclosed herein has been discovered, which provides efficient signaling at multiple resonance frequencies over a very wide band between 700 MHz and 2700 MHz. The performance of the disclosed antenna exceeds that of conventional antennas and is further adapted on a flexible substrate and configured to conform about a curved device surface for integrating with a plurality of host devices.

Advantageous Effects of Invention

In addition to the wide band performance, the flexible polymer substrate provides the capability to conform the antenna about a curved surface of a device. While curved, the antenna continues to exhibit efficient performance over a wide band.

DESCRIPTION OF EMBODIMENTS

Figure 1:
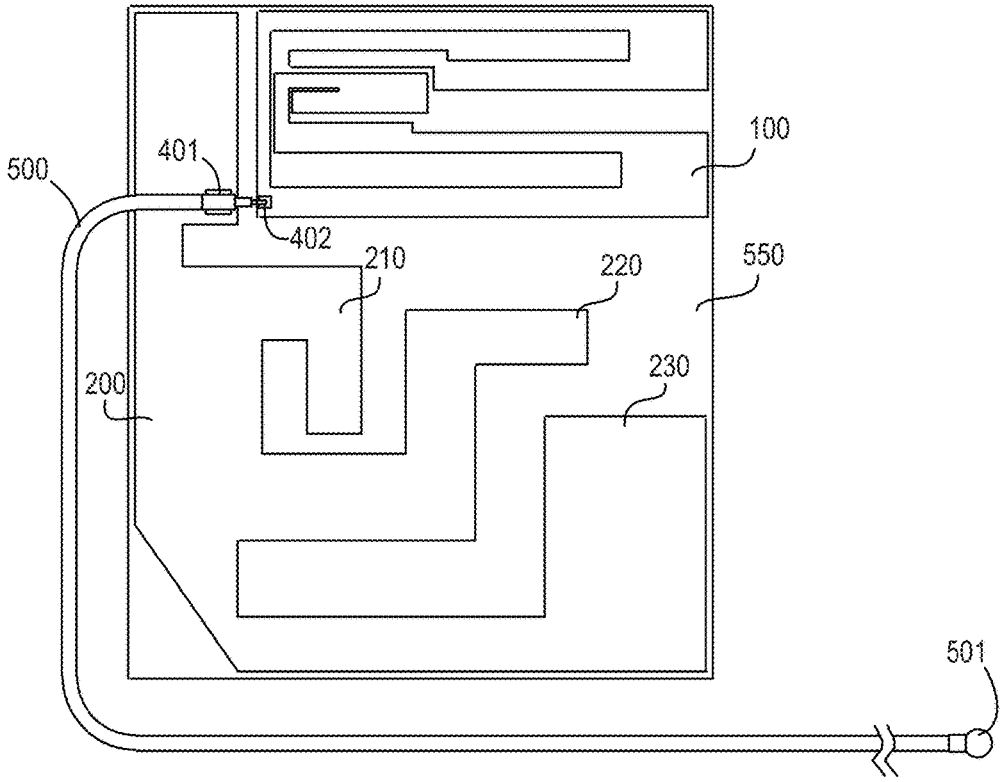
FIG. 1 shows an antenna assembly with multiple ground resonators, the antenna assembly includes a radiating element positioned on a substrate, and a ground conductor positioned on the substrate adjacent to the antenna radiating element, the ground conductor includes multiple resonating portions.

In various embodiments, an antenna is disclosed which includes: a substrate, an antenna radiating element disposed on the substrate, and a ground conductor, wherein the ground conductor comprises: a ground patch, a first ground resonator, a second ground resonator, and a third ground resonator; wherein the ground conductor surrounds the antenna radiating element about two sides thereof and provides for multiple resonant frequencies forming a wide band response.

The antenna radiating element of the antenna assembly (that which is fed by the center element of the coaxial cable) is known to work well in other designs provided that the ground plane is sufficiently large. A motivation of the instant antenna design is to improve the ground conductor of the antenna assembly to work with a flexible substrate and to achieve sufficient efficiency in the smallest form possible. In addition, the ground conductor is configured to allow the cable shield and its end connection to act as an extension to the ground plane.

Modern cellular applications, including 3G and 4G, often require the combination of high efficiency and small size over a large set of bands in the 700-2700 MHz range. The cable-fed flexible polymer antenna assembly is a commonly-used implementation of antennas for this market. It is often challenging to integrate such antennas into compact devices without degradation of return loss (and thus efficiency) due to proximity of nearby metal objects or improper routing of the cable.

This disclosure presents a novel antenna architecture with acceptable efficiency in a very small form using a known antenna radiating element and a unique multi-section wrapping ground conductor that is virtually extended by the feed cable. The structure was designed to concentrate the efficiency in those frequency bands where is it needed at the expense of those frequencies where the efficiency is not needed.

It is difficult to design an antenna with a small size that operates efficiently over all cellular bands in modern use.

On typical cable-fed quasi-dipoles, the ground is often too small for stable operation and the cable shield is relied upon to provide a ground conductor. This sort of cable-ground is non-ideal, as it cannot implement a resonant element.

For a small size antenna, in order to produce high efficiencies at low frequencies in the wide range of 700 MHz-960 MHz, it was discovered that the use of multiple wrapping ground resonators, each being progressively larger toward the outside, works well. Moreover, with the multiple ground resonators, the cable shield can act as the last resonator structure for the lowest frequency required.

It is known by experiment that covering the antenna radiating element with copper tape will produce low band performance that is not as good but still marginal and poor high band performance. It is also known that by covering the ground conductor with copper tape, the low band performance is nonexistent and high band performance is not as good but marginal. Therefore, it is necessary to have the proposed patterning on the ground conductor, not just a conductive sheet the same size.

A simple dipole would require approximately 210 mm of length to perform at 700 MHz.

With the disclosed antenna architecture, we measure high efficiencies down to 650 MHz within a space of 58 mm×67 mm. Thus, we can achieve better efficiencies at a much smaller size.

In addition, by forming the antenna assembly on a flexible substrate, we can conform the shape of the antenna assembly to any surface, such that the antenna can be mounted, or we can bend the antenna one time or multiple times.

The antenna has two main subsections: the antenna radiating element and the ground conductor. The ground conductor is novel in that it is composed of multiple sub-elements, each progressively larger and farther from the antenna radiating element, so that the last element is effectively the cable shield and its connection, i.e. typically a PCB ground. This gives a known and proper way to route the cable.

In one aspect, the antenna is combining the antenna radiating element with a new type of ground conductor composed of multiple (here three) sub-elements which wrap around and progressively get larger as the sub elements (resonators) approach the outer periphery of the antenna assembly. The cable shield will act as final element due to routing.

In another aspect, we propose using mini-coax cable as feeding technique of the antenna.

In yet another aspect, we propose manufacturing the antenna structure on flexible substrate, such as a polyimide (Kapton®) substrate, having the convenience of attached the antenna to any curved surface, or bend the antenna multiple times.

Example 1

Now turning to the drawings which illustrate an example, FIG. 1 shows an antenna assembly with multiple ground resonators, the antenna assembly includes a radiating element (100) positioned on a substrate (550), and a ground conductor (200) positioned on the substrate adjacent to the antenna radiating element, the ground conductor includes multiple resonating portions (210; 220; 230). A coaxial cable (500), such as a micro coaxial cable, includes a center element which is soldered to a feed (402) of the antenna radiating element (100). The center element of the coaxial cable is generally separated from a ground element by an insulator therebetween. The ground element (401) of the coaxial cable is soldered to the ground conductor (200) as shown. The coaxial cable (500) is then routed in typical fashion; i.e. around a periphery of the antenna assembly. Moreover, the cable generally includes a connector (501) for connecting to a radio circuit.

As appreciated from FIG. 1, the antenna assembly includes a radiating element (100) and ground conductor (200); wherein the ground conductor is configured to surround the antenna radiating element on two sides thereof. Moreover, the ground conductor includes a plurality of sub-elements (also called "resonators"), wherein a length of each resonator increases as distance of the resonator from the radiating element increases. The routed cable is configured to act as an additional resonator, and comprises a length larger than each of the other resonators of the ground conductor.

Figure 2:
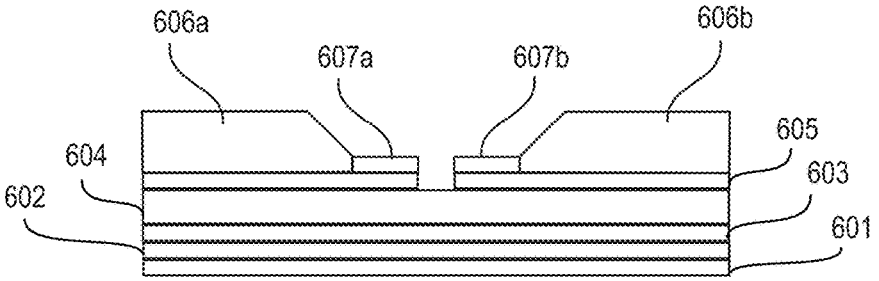
FIG. 2 shows a cross-section of the antenna assembly (not to scale).

FIG. 2 shows a cross-section of the antenna assembly (not to scale). The antenna assembly includes a flexible polymer substrate (604), such as a polyimide substrate or any substrate with a flexible or bendable body. A solder mask layer (603) is applied to an underside of the flexible polymer substrate. An adhesive layer (602) is applied to an underside of the solder mask layer in accordance with the illustration. A liner (601) is applied to the adhesive layer as shown forming the bottom surface of the antenna assembly. Still further, a copper layer (605), according to the design shown in FIG. 1, is provided on a top surface of the flexible polymer substrate (604) as shown. Conductive pads (607*a*; 607*b*) and solder mask (606*a*; 606*b*) each are applied to the copper layer (605), thereby forming a top surface of the antenna assembly. While the illustrated example enables those having skill in the art to make and use the invention, it will be recognized by the same that certain variations may be implemented without departing from the spirit and scope of the invention.

Figure 3:
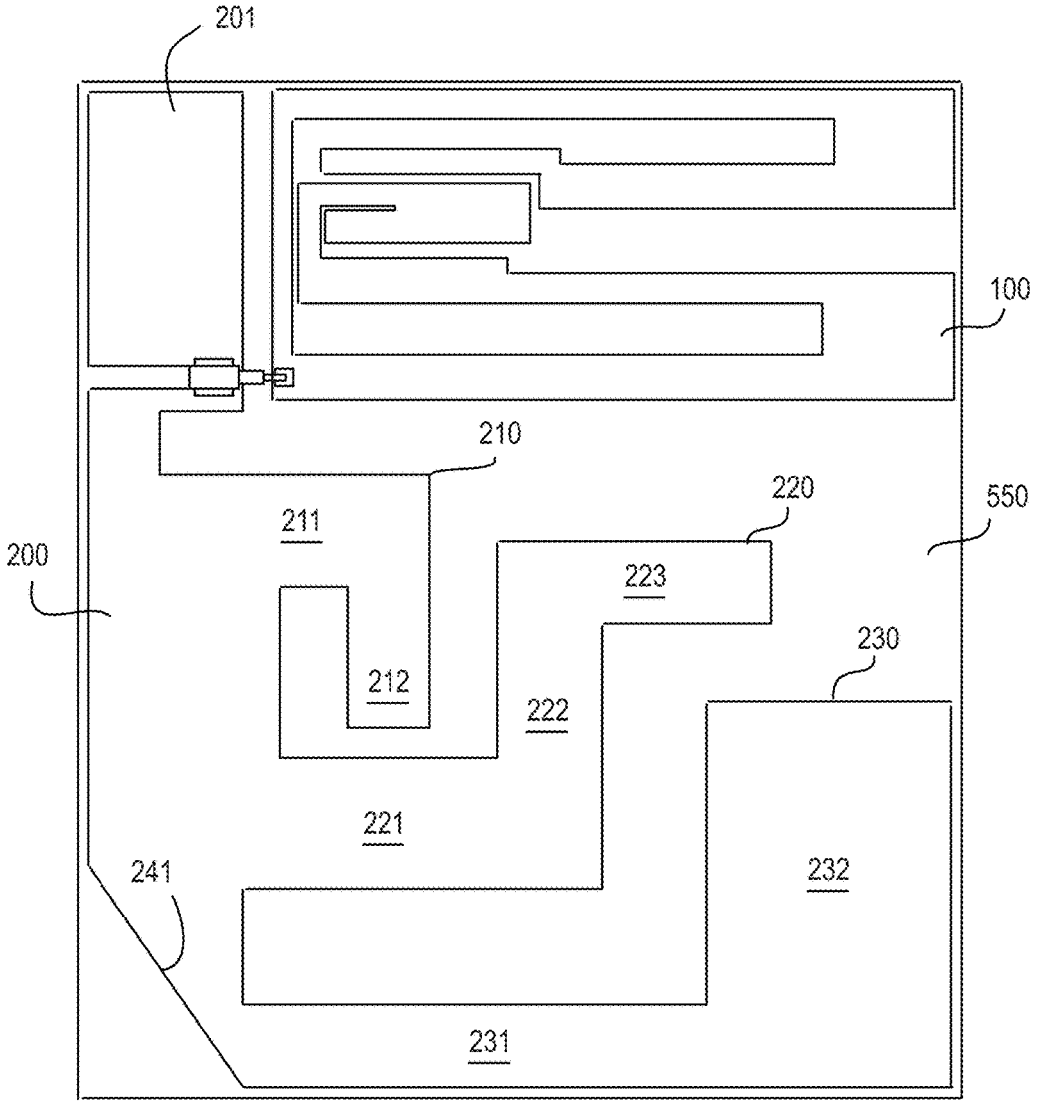
FIG. 3 further shows the ground conductor and multiple resonating portions associated therewith.

FIG. 3 further shows the ground conductor and multiple resonators associated therewith. Here, the ground conductor includes a ground patch (201) positioned adjacent to the antenna radiating element (100).

Moving downward along a first edge of the antenna assembly as shown, a first ground resonator (210) extends horizontally from the edge along a first body portion (211) and is bent at a right angle toward a first terminal portion (212).

A second ground resonator (220) extends from the first edge of the antenna assembly as shown, the second ground resonator including a second horizontal body portion (221), a second vertical body portion (222), and a second terminal portion (223). The second ground resonator includes a length greater than that of the first ground resonator. The second ground resonator is also positioned along the ground conductor at a distance that is greater than that of the first ground resonator. The second vertical body portion (222) of the second ground resonator (220) is aligned parallel with the terminal portion (212) of the first ground resonator, with a first gap extending therebetween.

A third ground resonator (230) extends from the ground conductor (200) forming a third horizontal body portion (231) which is oriented parallel with respect to the second horizontal body portion (221) of the second ground conductor, and a third vertical body portion (232) extending perpendicularly from the third horizontal body portion (231). The third ground resonator includes a length that is larger than each of the first and second ground resonators, respectively. Moreover, the third ground conductor is positioned at a distance from the radiating element (100) that is larger than that of the first and second ground resonators, respectively. A second gap is formed between the second ground resonator and the third ground resonator. The ground conductor (200) further includes cleave portion (241) extending between the first edge and the third ground resonator at an angle less than ninety degrees.

Referring back to FIG. 1, the cable (500) has a length larger than that of each of the first through third ground resonators, and is positioned further away from the radiating element (100) compared to each of the first through third ground resonators.

As used herein, each of the terms "horizontal", "vertical", "parallel" and/or "perpendicular", or variations of these terms such as "horizontally", etc., are used with reference to the specific orientation as shown in the corresponding illustrations.

Figure 4:
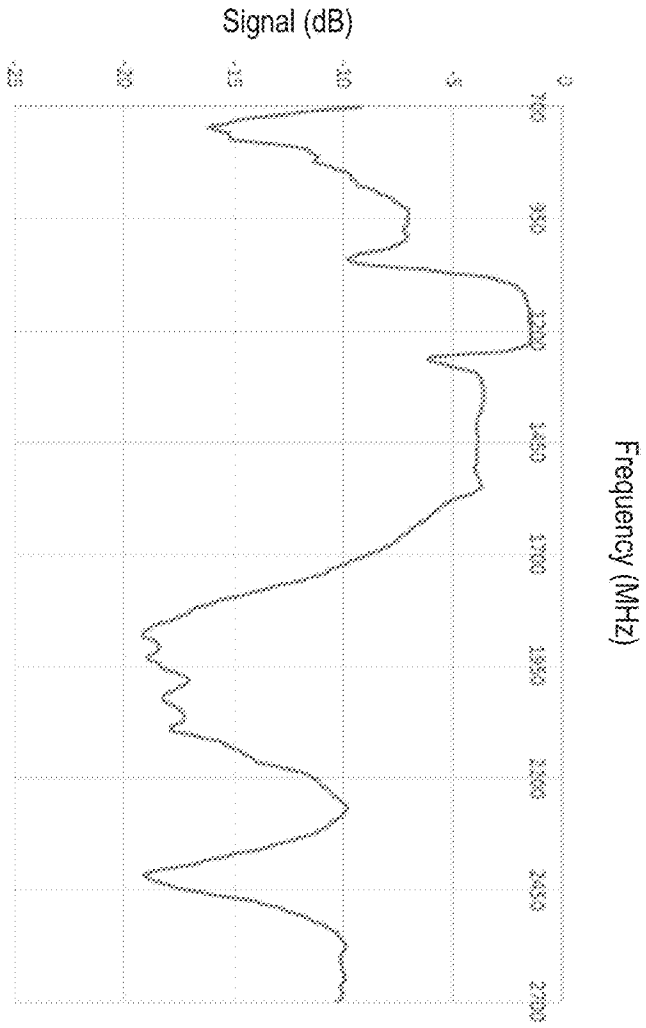
FIG. 4 shows a plot of return loss generated from the antenna assembly of FIGS. 1-3.

FIG. 4 shows a plot of return loss generated from the antenna assembly of FIGS. 1-3. The antenna has resonances between 700 MHz and 2700 MHz as illustrated.

Figure 5:
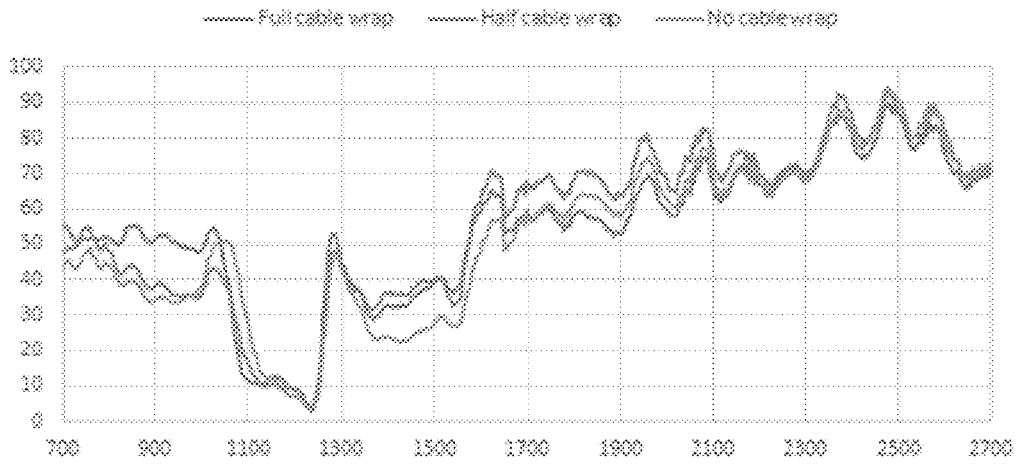
FIG. 5 shows a plot of efficiency of the antenna assembly of FIGS. 1-3.

FIG. 5 shows a plot of efficiency of the antenna assembly of FIGS. 1-3.

Figure 6:
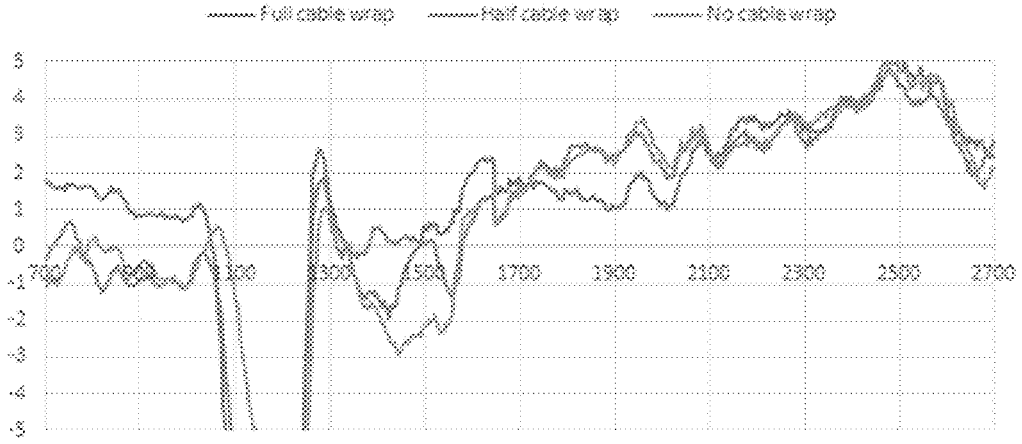
FIG. 6 shows a plot of peak gain associated with the antenna assembly of FIGS. 1-3.

FIG. 6 shows a plot of peak gain associated with the antenna assembly of FIGS. 1-3.

INDUSTRIAL APPLICABILITY

The instant antenna assembly as disclosed herein provides useful efficiency and performance in the wide band between 700 MHz and 2700 MHz, which can be used in cellular communications among other communication networks.

REFERENCE SIGNS LIST (100) antenna radiating element
(200) ground conductor
(201) ground patch
(210) first ground resonator (sub-element)
(211) first body portion
(212) first terminal portion
(220) second ground resonator (sub-element)
(221) second horizontal body portion
(222) second vertical body portion
(223) second terminal portion
(230) third ground resonator (sub-element)
(231) third horizontal body portion
(232) third vertical body portion
(241) cleave portion
(401) ground element
(402) feed
(500) coaxial cable
(501) connector
(550) substrate
(601) liner
(602) adhesive layer
(603) solder mask layer
(604) flexible polymer substrate
(605) copper layer
(606*a*; 606*b*) solder mask
(607*a*; 607*b*) conductive pads

What is claimed is:

1. An antenna assembly, comprising:
an antenna radiating element; and
a ground conductor comprising a ground patch and a plurality of sub-elements configured to produce a distinct resonance,
wherein the ground conductor surrounds two sides of the antenna radiating element,
further wherein the antenna radiating element is positioned adjacent to the ground conductor.

2. The antenna assembly of claim 1, wherein each of the antenna radiating element and the plurality of sub-elements of the ground conductor are disposed on a flexible substrate.

3. The antenna assembly of claim 2, wherein the plurality of sub-elements further comprises:
a first ground resonator,
a second ground resonator, and
a third ground resonator.

4. The antenna assembly of claim 3, wherein the first ground resonator comprises a first length.

5. The antenna assembly of claim 4, wherein the second ground resonator comprises a second length, and further wherein the second length is greater than the first length of the first ground resonator.

6. The antenna assembly of claim 5, wherein the third ground resonator comprises a third length, and further wherein the third length is greater than each of the first length of the first ground resonator and the second length of the second ground resonator.

7. The antenna assembly of claim 1, further comprising a coaxial cable coupled to a feed of the antenna radiating element and further coupled to the ground conductor wherein the coaxial cable is positioned around a periphery of the antenna assembly.

8. The antenna assembly of claim 7, wherein the coaxial cable is configured to function as a fourth ground resonator.

9. The antenna assembly of claim 2, wherein the antenna radiating element is positioned at a corner of the flexible substrate.

10. The antenna assembly of claim 2, wherein the ground conductor extends along a first edge of the flexible substrate.

11. The antenna assembly of claim 3, wherein the first ground resonator and second ground resonator extends from a first edge of the flexible substrate.

12. The antenna assembly of claim 11, wherein the first ground resonator comprises a first body portion extending perpendicularly from the first edge of the flexible substrate, and a first terminal portion extending perpendicularly from the first body portion of the first ground resonator.

13. The antenna assembly of claim 11, wherein the second ground resonator comprises a second horizontal body portion extending perpendicularly from the first edge of the flexible substrate, a second vertical body portion extending perpendicularly from the second horizontal body portion, and a second terminal portion extending perpendicularly from the second vertical body portion.

14. The antenna assembly of claim 3, wherein the third ground resonator comprises a cleave portion extending from a first edge of the flexible substrate, a third horizontal body portion extending from the cleave portion, and a third vertical body portion extending perpendicularly from the third horizontal body portion.

15. An antenna assembly, comprising:
a flexible substrate;
an antenna radiating element;
a ground conductor extending along a portion of a first edge of the flexible substrate, the ground conductor comprising a ground patch and a plurality of sub-elements configured to produce a distinct resonance; and
a coaxial cable coupled to a feed of the antenna radiating element and further coupled to the ground conductor wherein the coaxial cable is positioned around a periphery of the antenna assembly wherein the coaxial cable is configured to function as a ground resonator,
wherein the antenna radiating element is positioned adjacent to the ground conductor.

16. The antenna assembly of claim 15, wherein the plurality of sub-elements of the ground conductor further comprises:
a first ground resonator,
a second ground resonator, and
a third ground resonator.

17. The antenna assembly of claim 16, wherein first ground resonator comprises a first length.

18. The antenna assembly of claim 17, wherein the second ground resonator comprises a second length, and further wherein the second length is greater than the first length of the first ground resonator.

19. The antenna assembly of claim 18, wherein the third ground resonator comprises a third length, and further wherein the third length is greater than each of the first length of the first ground resonator and the second length of the second ground resonator.

20. The antenna assembly of claim 16, wherein the first ground resonator and the second ground resonator extends from the first edge of the flexible substrate.

21. The antenna assembly of claim 15, wherein the antenna radiating element is positioned at a corner of the flexible substrate.

22. The antenna assembly of claim 15, wherein the ground conductor is configured to surround two sides of the antenna radiating element.

* * * * *